United States Patent [19]

Kimura et al.

[11] Patent Number: 4,623,240

[45] Date of Patent: Nov. 18, 1986

[54] METHOD OF DRYING ELECTROPHOTOSENSITIVE MEMBER IN ELECTROPHOTOGRAPHIC RECORDING OR COPYING SYSTEM OF WET TYPE

[75] Inventors: Akinori Kimura; Shuichi Ohtsuka, both of Kanagawa, Japan

[73] Assignee: Fuji Photo Film Co., Ltd., Kanagawa, Japan

[21] Appl. No.: 696,590

[22] Filed: Jan. 31, 1985

[51] Int. Cl.[4] ..... G03G 15/10

[52] U.S. Cl. ..... 355/10; 430/117; 118/659

[58] Field of Search ..... 355/10, 16, 27; 354/3; 118/659, 662; 430/117-119

[56] References Cited

U.S. PATENT DOCUMENTS 3,683,852 8/1972 Yamaguchi et al. ..... 355/10 X 4,461,561 7/1984 Plumadore ..... 355/16 X

*Primary Examiner*—Arthur T. Grimley

*Assistant Examiner*—J. Pendegrass

[57] ABSTRACT

A method of drying electrophotosensitive film by bringing the film into intimate contact with a specific area of a develop-mask of a liquid developing station, blowing gas against the film while maintaining such contact and to such an extent that a film of liquid developer remains on the photosensitive film, and while in such condition moving the photosensitive film to a drying station having a drying opening of an area larger than that defined by the developing mask, thereby uniformly drying the specific area wetted by the liquid developer.

4 Claims, 8 Drawing Figures

METHOD OF DRYING ELECTROPHOTOSENSITIVE MEMBER IN ELECTROPHOTOGRAPHIC RECORDING OR COPYING SYSTEM OF WET TYPE

BACKGROUND OF THE INVENTION (1) Field of the Invention

This invention relates to the step of drying carried out after the step of development of an electrophotosensitive member, for example, a microfilm with a liquid developer, and more particularly to a drying method which can attain a speedup of the drying step without causing non-uniform drying of the developed area of the electrophotosensitive member.

(2) Description of the Prior Art

In an electrophotographic recording (or copying) system of the so-called wet type in which an electrophotosensitive member, for example, a microfilm is developed with a liquid developer, picture image data are generally recorded or copied on the electrophotosensitive member such as a microfilm after being subjected to five processing steps, that is, the steps of charging, exposing, developing, drying and fixing. More precisely, in the first or charging step, the surface of the electrophotosensitive member is electrostatically charged as by corona discharge. In the succeeding exposing step, a picture image data to be recorded is projected onto the charged area of the electrophotosensitive member through a lens or the like to form an electrostatic latent image on the exposed area of the electrophotosensitive member. Then, the electrophotosensitive member having the electrostatic latent image formed thereon is fed to the developing step where a liquid developer is applied to the specific area of the sensitive surface, whereby the toner is attracted and held by the Coulomb's force on the specific area according to the pattern of the electrostatic latent image. Subsequently, the electrophotosensitive member is fed to the drying step where the solvent in the liquid developer is vaporized to be removed. In the final fixing step, the toner electrically held on the specific area of the sensitive surface of the electrophotosensitive member is fixed by means such as heating, pressurizing or resin coating. Thus, the picture image data is permanently preserved on the surface of the electrophotosensitive member.

The electrophotographic recording or copying system described above is advantageous in that, since all the processing steps including the steps of developing and fixing proceed sequentially after exposure of a picture image data, the recorded picture image can immediately be reproduced when so desired. Further, since the electrophotosensitive member is not sensitive to radiation until it is charged, the electrophotographic recording or copying system is advantageous in that the electrophotosensitive member need not be completely shielded against light during storage or during projection with a reader. Thus, recording by the electrophotographic method is now being put into practical use not only in the field of the so-called copier system but also in the field of the microfilm system.

In the electrophotographic recording system described above, the toner electrically attracted and held on the electrophotosensitive member prior to the step of fixing must be fixed immediately after the steps of exposing and developing. Further, when the electrophotosensitive member is in the form of, for example, a roll film or a microfiche film which is used for recording of many picture image data on many frames, the individual frames must be sequentially subjected to the processing steps described above. One of requirements in such a case is that the liquid developer must not flow out to a place other than the electrophotosensitive member or the liquid developer must not leak toward a frame or frames other than the frame to be developed. It is another requirement that the solvent in the liquid developer must be sufficiently vaporized to be removed from the surface of the specific area of the sensitive surface before the step of fixing. This is because, when the step of fixing is carried out while the solvent remains still on the surface of the specific area, the quality of the fixed picture image data will be degraded due to the tendency of occurrence of the blister on the specific area in the case of fixing by heating, the tendency of flowing of the toner in the case of fixing by pressurizing, or the tendency of uncuring of the resin in the case of fixing by resin coating. Therefore, a relatively large length of time has been required for the removal of the solvent.

In an effort to solve such a problem, a developing device as shown in FIG. 1 has been proposed. The developing device shown in FIG. 1 is commonly called a developing head when its developing section is formed independently of other processing sections, while the device is commonly called a developing section when it is formed integrally with other processing sections.

Referring to FIG. 1, the developing head or developing section is generally designated by the reference numeral 1 and has a cavity 12 which defines a developing chamber. A developing mask 2 surrounds or masks the periphery of the developing chamber 12, and an electrophotosensitive member 3 is brought into intimate engagement at its sinsitive surface with the end face **2*b* of the masking frame portion 2*a* of the developing mask 2 by a pressing plate or the like (not shown). The inner peripheral shape of the masking frame portion 2*a* of the developing mask 2 conforms to the shape of a predetermined area to be developed, for example, the area of one frame of the electrophotosensitive member 3. The developing head or developing section 1 is formed with three passages communicating with its developing chamber 12, that is, a liquid-developer introduction passage 5, a gas intake passage 6 and a discharge passage 7. A liquid developer 4 contained in a liquid developer tank 8 is supplied to the liquid-developer introduction passage 5 by a developer feed pump 13, so that the liquid developer 4 of a predetermined quantity is sprayed onto an exposed area of the electrophotosensitive member 3. A developing electrode 11 is disposed opposite to the sensitive surface of the electrophotosensitive member 3 to assist in the electrical attraction of the toner in the liquid developer 4 toward and onto the sensitive surface of the electrophotosensitive member 3. A portion of the liquid developer 4 sprayed onto the electrophotosensitive member 3 flows down along the sensitive surface of the electrophotosensitive member 3 to return through the discharge passage 7 into the developer tank 8. After the supply of the liquid developer 4 has been completed, that is, after the development has been completed, the excess of the liquid developer is squeezed. For this purpose, a valve 16 is interposed in the gas intake passage 6 connected to a gas source such as a gas pump or a gas cylinder (not shown). The valve 16 is opened to permit flowing of a gas such as air into the developing chamber 12 by way of the gas intake passage 6, so that the solvent of the liquid developer 4 remaining on the sensitive surface of the electrophotosensitive member 3 can be vaporized and the liquid developer 4 attaching to various portions including the inner wall of the developing chamber 12 can be blown away. At the same time, a suction pump 15 is operated so that the liquid developer 4 held in the gap between the electrophotosensitive member 3 and the end face 2***b* of the masking frame portion 2*a* of the developing mask 2 can be sucked to be trapped in the trap 14 through a suction slit 9 and a suction conduit 10. This sucking operation is continued until the specific area of the electrophotosensitive member 3 is fed to the succeeding drying step so that the substantial portion of the liquid developer 4 held between the end face 2*b* of the masking frame portion 2*a* of the developing mask 2 and the electrophotosensitive member 3 can be drawn out when the specific area of the electrophotosensitive member 3 leaves the end face 2*b* of the masking frame portion 2*a*.

The succeeding step of drying can be completed within a short period of time when the excess of the liquid developer 4 is squeezed in the manner described above while the specific area of the electrophotosensitive member 3 remains still in the position opposite to the developing chamber 12.

It has been considered preferable that the liquid developer 4 is to be squeezed as completely as possible in the developing step. FIG. 2 is a graph showing the results of an experiment conducted to find the relation between the duration of gas supply through the gas intake passage 6 and the quantity of the liquid developer 4 remaining on the electrophotosensitive member 3. A 16-mm microfilm was used as the electrophotosensitive member 3 in the experiment, and the area of the square opening of the developing chamber 12 was 10 mm×10 mm. In FIG. 2, the curve A represents the relation when squeezing gas only was supplied in the absence of any suction, while, the curve B represents the relation when squeezing gas was supplied in the presence of suction.

It will be seen in FIG. 2 that the quantity of the liquid developer 4 remaining on the sensitive surface of the electrophotosensitive member 3 shows a remarkable decrease within a period of time of 1 second after the starting of the gas supply only or after the starting both the gas supply and the suction, but it shows a very slight decrease thereafter. This is considered to be attributable to the fact that the liquid developer held between the electrophotosensitive member 3 and the end face 2*b* of the masking frame portion 2*a* of the developing mask 2 is not completely removed regardless of whether or not the suction is applied.

When, on the contrary, squeezing gas is continuously supplied for a long period of time of, for example, more than 2 seconds, partial drying starts to occur on the portion of the electrophotosensitive member 3 facing the opening of the developing chamber 12. Transfer of the electrophotosensitive member 3 in such a partly dried condition to the succeeding step of drying is undesirable in that, when the specific portion of the electrophotosensitive member 3 leaves the end face 2*b* of the masking frame portion 2*a* of the developing mask 2, the liquid developer 4 held therebetween flows out onto the dried surface portion of the electrophotosensitive member 3 and is dried again thereafter, thereby giving rise to non-uniform drying resulting in an objectionable degradation of the quality of the recorded picture image data.

SUMMARY OF THE INVENTION

With a view to solve the prior art problem pointed out above, it is a primary object of the present invention to provide a method of drying an electrophotosensitive member in an electrophotographic recording or copying system of wet type, which prevents non-uniform drying of the electrophotosensitive member while, at the same time, attaining a sppedup of the drying step.

In accordance with the present invention which attains the above object, there is provided a method of drying an electrophotosensitive member in an electrophotographic recording or copying system of wet type comprising the steps of bringing a developing mask of a developing section into intimate engagement with an exposed electrophotosensitive member to define a specific area to be developed, supplying a liquid developer to said specific area of said electrophotosensitive member defined by said developing mask to develop said electrophotosensitive member, supplying a blast of squeezing gas into said developing section in the state in which said electrophotosensitive member makes intimate engagement with said developing mask of said developing section thereby squeezing said liquid developer to such an extent that a filmy layer of said liquid developer remains on the entire surface of said specific area, and causing relative movement of said electrophotosensitive member to a drying section from said developing section in the state in which the filmy layer of said layer developer remains still on the entire surface of said specific area thereby uniformly drying said specific area wetted with said liquid developer.

DESCRIPTION OF THE PREFERRED EMBODIMENTS

A preferred embodiment of the present invention will now be described in detail with reference to FIGS. 3 to 5.

Figure 3:
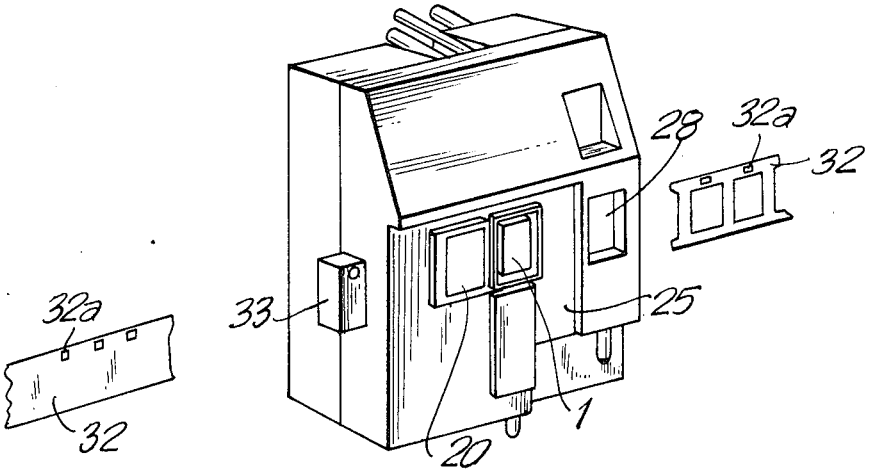
FIG. 3 is a schematic perspective view of a one-piece type process head preferably used in the practice of an embodiment of the method according to the present invention.
Figure 4A:
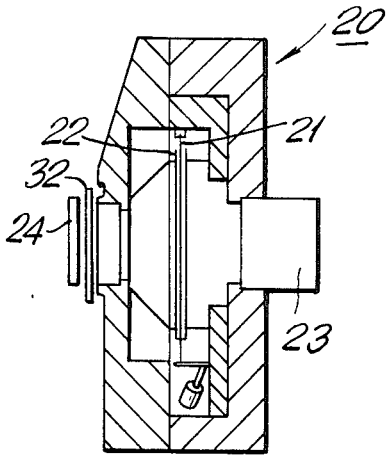
FIGS. 4(*a*) to 4(*d*) are schematic sectional views of the individual sections respectively of the process head shown in FIG. 3.
Figure 4B:
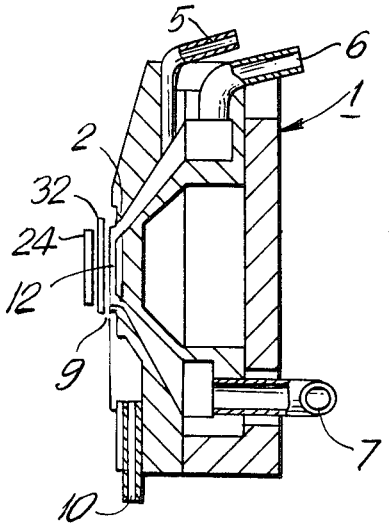
Figure 4C:
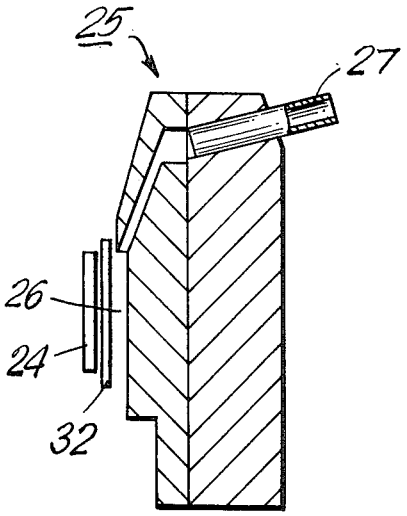
Figure 4D:
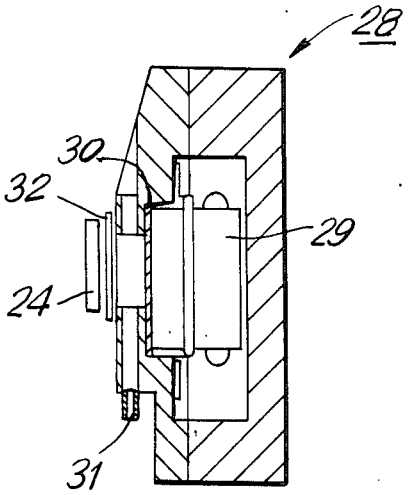

FIG. 3 is a schematic perspective view of a one-piece type microfilm process head which is adapted to carry out a sequence of processing steps from an exposing step to a final fixing step. Referring to FIG. 3, the process head includes a charging and exposing section 20, a developing section 1, a drying section 25 and a fixing section 28. A 16-mm electrophotographic film 32 is formed with a series of blip marks 32*a* which are sequentially sensed by a blipmark sensor 33 provided on the process head.

Figure 1:
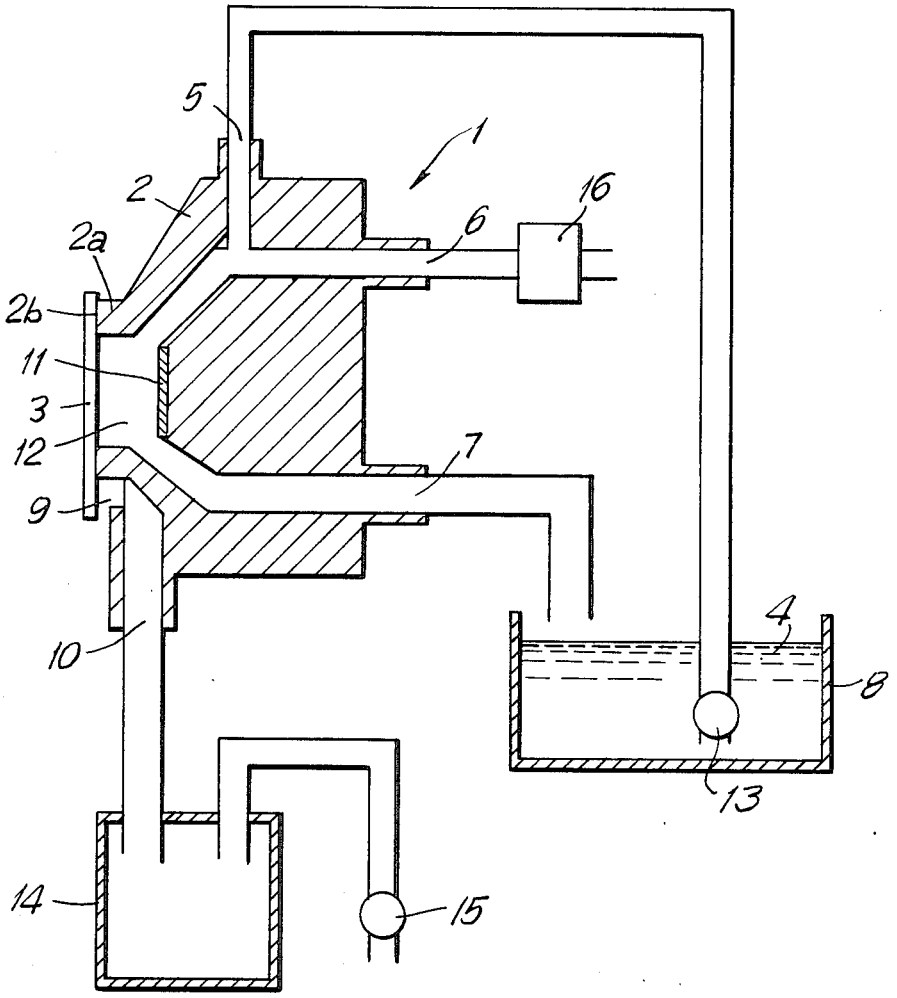
FIG. 1 (PRIOR ART)
FIG. 1 illustrates schematically the structure of a prior art developing head or a developing section.
Figure 2:
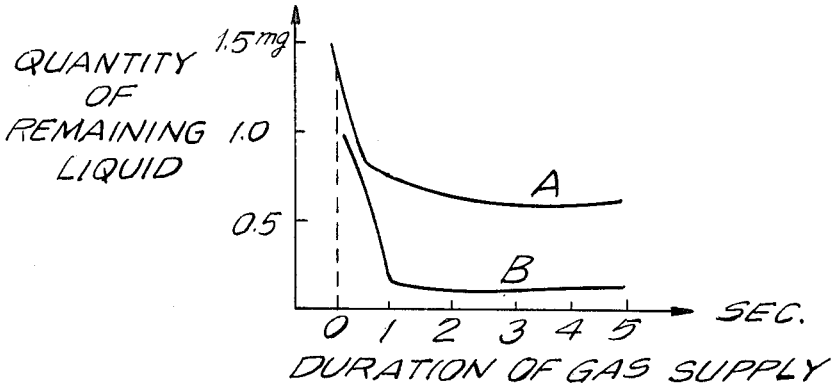
FIG. 2 is a graph showing the relation between the duration of squeezing gas supply and the quantity of a liquid developer remaining on an electrophotosensitive member in the case of the developing head or section shown in FIG. 1.

FIGS. 4(*a*) to 4(*d*) show schematically the structure of the individual sections respectively of the process head. Referring to FIG. 4(*a*), the charging and exposing section 20 includes a corona wire 21, a side electrode 22, a lens 23 and a film pressing plate 24. Referring to FIG. 4(*b*), the developing section 1 is the same in its detailed structure as that shown in FIG. 1, and the film 32 is brought into intimate engagement with the developing mask 2 by the film pressing plate 24. The area of the square opening of the developing mask 2 is 10 mm×10 mm. Referring to FIG. 4(*c*), the drying section 25 includes a drying chamber 26 and a drying-gas intake conduit 27. Referring to FIG. 4(*d*), the fixing section 28 includes a xenon lamp 29, a glass plate 30 and a suction conduit 31.

Figure 5:
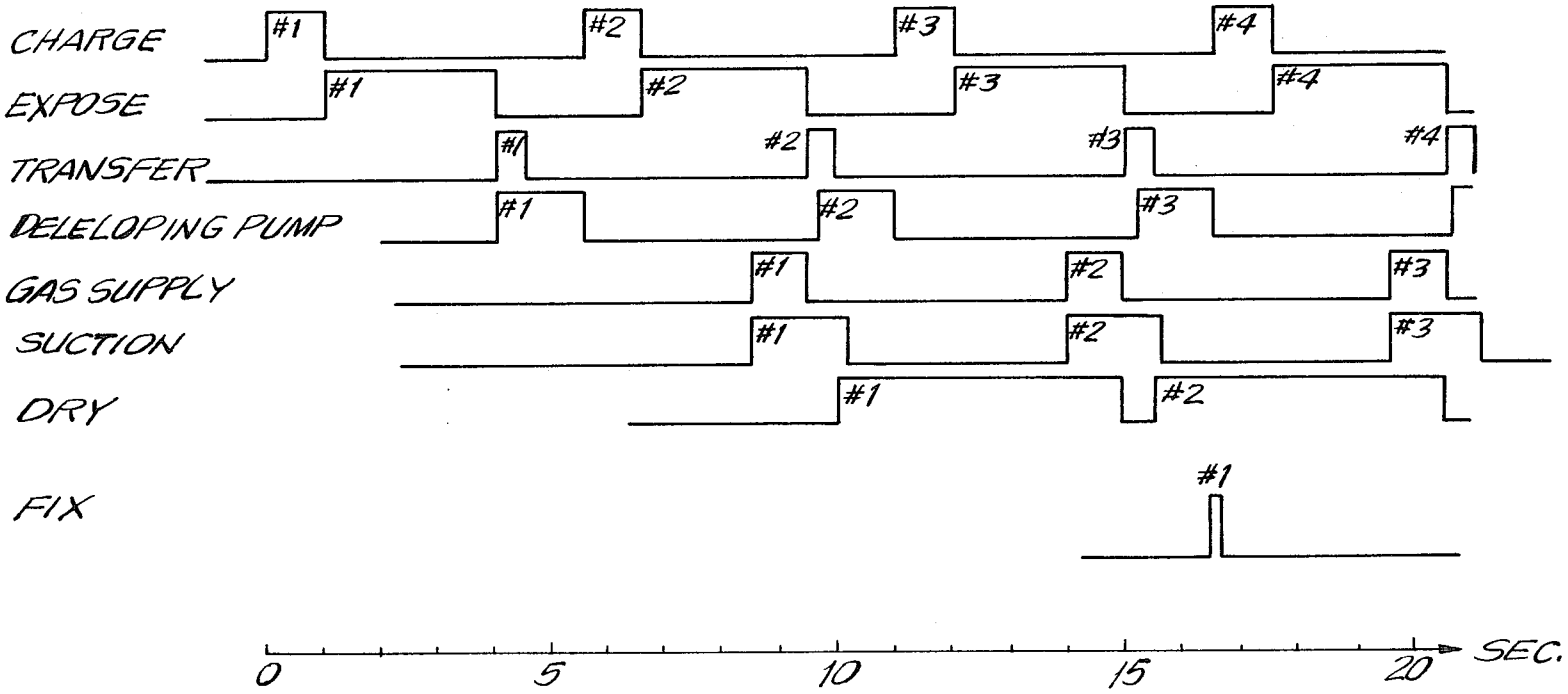
FIG. 5 is a time chart showing an example of the sequence of processing according to the present invention.

FIG. 5 is a time chart showing an example of the sequence of processing by the one-piece type process head shown in FIG. 3. Symbols #1 to #4 in FIG. 5 indicate the frame numbers of the fim. 32. Consider now the processing of the frame #1 of the film 32. After the frame #1 of the film 32 is positioned opposite to the charging and exposing section 20 and pressed by the film pressing plate 24, it is electrostatically charged initially for 1 second and then exposed for 3 seconds. Then, the film pressing plate 24 is disengaged, and the film 32 is fed to the developing section 1 for 0.5 seconds. In the developing section 1, the film 32 is brought into intimate engagement with the developing mask 2 by the film pressing plate 24, and the developing pump 13 is operated for about 1.5 seconds to spray the liquid developer 4 onto the frame #1 only of the film 32. The process head used in the embodiment of the method of the present invention is so designed that the frame #2 of the film 32 is already positioned opposite to the charging and exposing section 20 in the above state, and photographing is made as required before the operation of the developing pump 13 takes place. Then, immediately before feeding the frame #1 from the developing section 1, a blast of squeezing gas is directed toward the frame #1 for about 1 second. The quantity of gas blast in this case is about 5 liters per minute. Although this blast of squeezing gas reduces the quantity of the residual liquid developer to less than 0.5 mg/frame, a filmy layer of the liquid developer remains to wet the entire surface of the frame #1. The squeezing of the liquid developer is completed in such a state in which the entire surface of the frame #1 is wetted with a filmy layer of the liquid developer. Thereafter, the film pressing plate 24 is disengaged, and the film 32 is fed over a stroke corresponding to one frame thereby transferring the frame #1 to the drying section 25. In the process head used in the embodiment of the method of the present invention, application of suction starts from the beginning of squeezing gas supply and ends immediately before the transfer of the film 32 to the drying section 25. In the drying section 25, a blast of drying gas, for example, air is directed toward the frame #1 for about 5 seconds thereby drying the entire surface of the frame #1. In this case, the area of the opening of the drying chamber 26 is preferably larger than that of the masking frame portion 2*a* of the developing mask 2 so that the portion of the film 32 engaged by the end face 2*b* of the masking frame portion 2*a* of the developing mask 2 can also be dried. Since the frame #1 of the film 32 is transferred to the drying section 25 in the state in which its entire surface is wetted with the liquid developer, the frame #1 is uniformly dried. While the frame #1 is being dried, the frame #2 is subjected to development and squeezing, and the frame #3 is subjected to charging and exposure. Then, the film 32 is fed over the stroke corresponding to one frame, and the frame #1 is heated in the fixing section 28 for a short length of time by the xenon lamp 29 to be finally fixed. It is apparent that the frames #2, #3 . . . are similarly processed.

In the aforementioned embodiment of the present invention, the blast of squeezing gas is directed for about 1 second immediately before one of the frames of the film is transferred from the developing section. However, this blast of gas may be supplied at any time between the time of development of one of the frames of the film and the time of transfer of that frame to the drying section. Also, although the suction is applied between the time of starting of the squeezing gas supply toward one of the frames of the film and the time of transfer of that frame to the drying section, the application of suction is in no way limited to such a specific period, and the suction may be applied, for example, continuously. Further, although the film 32 is moved relative to the process head in the afore-mentioned embodiment of the present invention, it is apprent that the present invention is equally effectively applicable to the case in which the process head is moved relative to the film which is fixed. Also, the present invention is equally effectively applicable to the case in which the developing section, drying section and other sections are provided independently of one another without being integrated into the one-piece process head. The present invention is also applicable to a case in which special liquid dveloper is used and the toner is fixed by merely drying without requiring the step of fixing. The present invention is also applicable to an electrophotographic system of the kind as disclosed in Japanese Patent Laid-open No.53-76035(1978) in which a film is exposed after positive-negative double charging and is re-charged in the presence or absence of uniform irradiation to selectively obtain a positive picture and a negative picture.

It will be understood from the foregoing detailed description of the present invention that a liquid developer is supplied to an exposed area of an electrophotosensitive member in a state in which a developing mask makes intimate engagement with the specific area of the electrophotosensitive member. Therefore, the liquid developer would not leak to the outside of the specific area. Further, by virtue of the fact that a blast seuqezing gas is directed to the specific area of the electrophotosensitive member positioned opposite to the developing section for the purpose of squeezing, the period of time required for drying is shortened. Further, according to the present invention, the liquid developer is squeezed to such an extent that a filmy layer of the liquid developer remains still on the entire surface of the specific area of the electrophotosensitive member.

Therefore, even when the portion of the liquid developer that may be held between the electrophotosensitive member and the developing mask may flow out during transfer of the electrophotosensitive member to the drying section, nonuniform drying would not occur since the entire surface of the specific area of the electrophotosensitive member is wetted still with the liquid developer.

We claim:

1. A method of drying an electrophotosensitive member in an electrophotographic recording or copying system of the wet type comprising the steps fo bringing a developing mask of a developing section into initmate engagement with an exposed electrophotosensitive member to define a specific area to be developed, supplying a liquid developer only to said specific area of said electrophotosensitive member defined by said developing mask to develop said electrophotosensitive member, supplying a blast of squeezing gas into said developing section while said electrophotosensitive member is in intimate engagement with said developing mask of said developing section, thereby sequeezing said liquid developer to such an extent that a filmy layer of said liquid developer remains on the entire surface of said specific area, causing relative movement of said electrophotosensitive member from said developing section to a drying section having an opening of an area which is larger than said specific area defined by said developing mask while the filmy layer of said liquid developer still remains on the entire surface of said specific area, and thereby uniformly drying said specific area wetted with said liquid developer.

2. A drying method as claimed in claim 1, wherein said electrophotosensitive member is a 16-mm film, said developing mask has a square opening of 10 mm×10 mm, and said blast of squeezing gas is supplied for about 1 second at a flow rate of about 5 l/min.

3. A drying method as claimed in claim 1, wherein suction is applied for sucking said liquid developer from within said developing section and continues from the time of the beginning of the supply of the blast of squeezing gas to the time of complete transfer of said specific area of said electrophotosensitive member to said drying section.

4. The drying method as claimed in claim 1, wherein said developing section and said drying section adjoin each other and are integrally formed as part of a one-piece process head.

* * * * *